US005721092A

United States Patent [19]

Murai et al.

[11] Patent Number: 5,721,092

[45] Date of Patent: Feb. 24, 1998

[54] IMAGE FORMING METHOD OF SILVER HALIDE COLOR PHOTOGRAPHIC LIGHT-SENSITIVE MATERIAL

[75] Inventors: Kazuhiro Murai, Odawara; Hiroshi Kita, Hino, both of Japan

[73] Assignee: Konica Corporation, Japan

[21] Appl. No.: 762,725

[22] Filed: Dec. 10, 1996

[30] Foreign Application Priority Data

Dec. 15, 1995 [JP] Japan ..... 7-327154

[51] Int. Cl.[6] ..... G03C 7/42

[52] U.S. Cl. ..... 430/393; 430/631

[58] Field of Search ..... 430/393, 631

[56] References Cited

U.S. PATENT DOCUMENTS 4,923,783 5/1990 Kobayashi et al. ..... 430/377

FOREIGN PATENT DOCUMENTS 0438156 7/1991 European Pat. Off. .
0476604 3/1992 European Pat. Off. .
0568850 11/1993 European Pat. Off. .
0601393 6/1994 European Pat. Off. .
0654708 5/1995 European Pat. Off. .
0697625 2/1996 European Pat. Off. .
2058521 6/1971 Germany .
2354336 5/1974 Germany .
3919551 12/1990 Germany .
7239542 12/1995 Japan .
1369838 10/1974 United Kingdom .

OTHER PUBLICATIONS

European Search Report EP 96 30 9003 with Annex.

*Primary Examiner*—Hoa Van Le
*Attorney, Agent, or Firm*—Jordan B. Bierman; Bierman, Muserlian and Lucas

[57] ABSTRACT

A method of forming an image is disclosed which comprises the steps of a) imagewise exposing a silver halide color photographic light sensitive material comprising a support and provided thereon, a photographic component layer comprising a light sensitive silver halide emulsion layer, the photographic component layer containing a compound represented by the following formula (I) or (II), b) color developed the exposed material, and c) bleach-fixing the developed material with bleach-fixer containing a silver ion in an amount of 0.04 to 0.11 mol/liter and an iron complex in which the iron (II) complex content is 5 to 35% based on the total iron complex content:

formula (I)

formula (II)

9 Claims, No Drawings

IMAGE FORMING METHOD OF SILVER HALIDE COLOR PHOTOGRAPHIC LIGHT-SENSITIVE MATERIAL

FIELD OF THE INVENTION

The present invention relates to an image forming method of a silver halide color photographic light sensitive material and particularly to an image forming method of a silver halide color photographic light sensitive material which can provide an excellent dye-forming efficiency of couplers, in rapid processing and in reduced replenisher replenishing processing.

BACKGROUND OF THE INVENTION

Generally, in order to obtain a color image from an exposed silver halide color photographic light sensitive material, the exposed material is color developed, desilvered, and then washed or stabilized. The desilvering process includes a bleaching and a fixing process, and a mono-bath bleach-fixing process.

Recently, rapid bleach-fixing processing is eagerly desired for the purpose of saving of resources and reduction in cost, and further, reduction of waste or reduction of bleach-fixer replenishing is eagerly desired for environmental protection. However, the reduction of waste or the reduction of the replenishing results in the following problem. The retention time of a bleach-fixer bath is extended, so that a silver ion concentration in the bleach-fixer is increased due to desilvering reaction and a carry-in of color developer to the bleach-fixer is also increased. As a result, a ferric (Fe III) complex, which is used in the bleach-fixer as a bleaching agent, an iron (III) complex of an aminopolycarboxylic acid such as an iron (III) complex of ethylenediaminetetraacetic acid, an iron (III) complex of propylenediaminetetraacetic acid or an iron (III) complex of diethylenetriaminepentaacetic acid, is decreased to produce a ferrous (Fe II) complex, resulting in deterioration of the bleach-fixer. It has been found that, when a high concentrated bleach-fixer is used to realize reduced replenishing, a ferrous (Fe II) complex is likely to produce.

The deterioration of the bleach-fixer causes retardation of desilvering and silver retention. Further, there occurs a serious leuco dye formation problem that the ferrous (Fe III) complex reduces a cyan dye to a colorless leuco dye, resulting in an insufficient cyan dye formation. It is well known that the deteriorated bleach-fixer is likely to cause the silver retention particularly in its high pH side and to cause the leuco dye formation problem in its low pH side.

In order to minimize deterioration of the bleach-fixer due to an increase of an ferrous complex promoted by rapid processing or reduced replenishing, various studies on the processing agent have been made. A technique minimizing occurrence of an ferrous complex is disclosed in Japanese Patent O.P.I. Publication Nos. 1-244453/1989 and 1-244454/1989, and a technique overcoming silver retention or minimizing a leuco cyan dye formation is disclosed in Japanese Patent O.P.I. Publication No. 6-161067/1994. Further, a technique giving excellent desilvering in the study on light sensitive materials is disclosed in Japanese Patent O.P.I. Publication Nos. 6-337507/1994.

However, in the process in which rapid processing and reduced replenishing are carried out, the above techniques have not been sufficient to overcome the silver retention or leuco dye formation problem, particularly when the processing amount of light sensitive materials is varied. In a process in which replenishing is reduced to produce substantially no waste, the leuco dye formation problem has been serious particularly under low pH condition.

SUMMARY OF THE INVENTION

Accordingly, an object of the invention is to provide an image forming method employing a silver halide color photographic light sensitive material which can overcome the leuco dye formation problem in the process in which rapid processing and reduced replenishing are carried out.

DETAILED DESCRIPTION OF THE INVENTION

The above object of the invention could be attained by the following method:

(1) A method of forming an image comprising the steps of:

a) imagewise exposing a silver halide color photographic light sensitive material comprising a support and provided thereon, at least one photographic component layer comprising a light sensitive silver halide emulsion layer, the silver halide emulsion layer containing at least one compound of compounds represented by the following formulas (I) and (II);

b) color developed the exposed material; and c) bleach-fixing the developed material with bleach-fixer containing a silver ion in an amount of 0.04 to 0.11 mol/liter and an iron complex, the iron complex consisting of 5 to 35% of an iron (I) complex and an iron (II) complex:

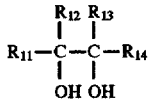

formula (I)

wherein $R_{11}$ represents an aliphatic group, an aromatic group, an acyl group, an aliphaticoxycarbonyl group, an aromaticoxycarbonyl group, an aliphaticoxy group or an aromaticoxy group; $R_{14}$ represents a hydrogen atom, an aliphatic group, an acyl group, an aliphaticoxycarbonyl group, an aromaticoxycarbonyl group, an aliphaticoxy group or an aromaticoxy group; and $R_{12}$ and $R_{13}$ independently represent a hydrogen atom, an aliphatic group or an aromatic group,

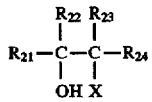

formula (II)

wherein $R_{21}$ and $R_{24}$ independently represent a hydrogen atom, an aliphatic group, an aromatic group, an acyl group, an aliphaticoxycarbonyl group, an aromaticoxycarbonyl group, an aliphaticoxy group or an aromaticoxy group; $R_{22}$ and $R_{23}$ independently represent a hydrogen atom, an aliphatic group or an aromatic group; and X represents a halogen atom, provided that $R_{21}$, $R_{22}$, $R_{23}$ and $R_{24}$ are not simultaneously hydrogen atoms.

(2) the method of forming an image of (1) above, wherein the compound represented by formula (I) or (II) is contained in a red sensitive layer containing a cyan coupler or its adjacent layer of the light sensitive material, (3) the method of forming an image of (1) or (2) above, wherein the silver halide emulsion layer comprises at least one selected from sparingly soluble epoxy compounds represented by the following formulas (III), (IV) and (V):

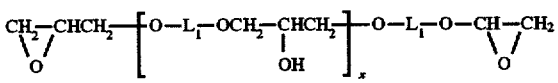

formula (III)

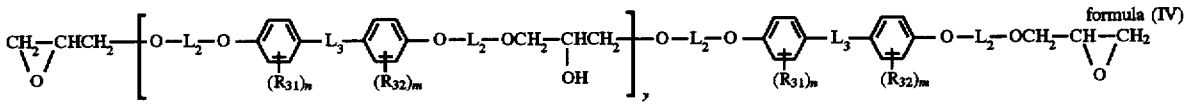

formula (IV)

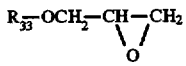

formula (V)

wherein $L_1$, $L_2$ and $L_3$ independently represent an alkylene group; $R_{31}$ and $R_{32}$ independently represent an aliphatic group or a halogen atom; $R_{33}$ represents an aliphatic group; x and y independently represent a real number of 0 to 20; and n and m independently represent an integer of 0 to 4, or (4) the method of forming an image of (1), (2) or (3) above, wherein the bleach-fixer has a pH of 5.0 to 6.5.

Next, the invention will be explained in detail. Firstly, 1,2 diols represented by formula (I) and halohydrins represented by formula (II) will be explained.

The aliphatic group represented by $R_{11}$, $R_{12}$, $R_{13}$, $R_{14}$, $R_{21}$, $R_{22}$, $R_{23}$ and $R_{24}$ includes a straight-chained, branched or cyclic alkyl group (for example, n-butyl, n-dodecyl, 2-ethylhexyl, 2-hexyldecyl, t-butyl, cyclopentyl, cyclohexyl) and a straight-chained, branched or cyclic alkenyl group (for example, propenyl, 1-methy-2-hexenyl or 2-cyclohexenyl).

The aromatic group represented by $R_{11}$, $R_{12}$, $R_{13}$, $R_{14}$, $R_{21}$, $R_{22}$, $R_{23}$ and $R_{24}$ includes phenyl, 1-naphthyl or 2-naphthyl.

The acyl group represented by $R_{11}$, $R_{12}$, $R_{21}$ and $R_{24}$ includes an aliphaticcarbonyl group or an aromaticcarbonyl group, and the aliphatic group of the aliphaticcarbonyl group and the aromatic group of the aromaticcarbonyl group are the same as those denoted in the above.

The aliphatic group of the aliphaticoxycarbonyl group represented by $R_{11}$, $R_{14}$, $R_{21}$ and $R_{24}$ is the same as those denoted in the above.

The aromatic group of the aromaticoxycarbonyl group represented by $R_{11}$, $R_{14}$, $R_{21}$ and $R_{24}$ is the same as those denoted in the above.

The aliphatic group of the aliphaticoxy group represented by $R_{11}$, $R_{14}$, $R_{21}$ and $R_{24}$ is the same as those denoted in the above and the aromatic group of the aromaticoxy group represented by $R_{11}$, $R_{14}$, $R_{21}$ and $R_{24}$ is the same as those denoted in the above.

The above described group may further have a substituent. The substituent includes an aliphatic group, an aromatic group, a heterocyclic group, a hydroxy group, a carboxy group, a sulfo group, a phosphoric acid group, a nitro group, a cyano group, an acylamino group, an acyloxy group, a carbamoyl group, an aliphaticoxycarbonyl group, an aromaticoxycarbonyl group, an acyl group, a sulfonamido group, a sulfamoyl group, a sulfonic acid ester group, a sulfonyl group, a sulfinyl group, a phosphonyl group, a phosphate group, a mercapto group, an aliphaticoxy group, an aromaticoxy group, an heterocyclicoxy group, an aliphaticthio group, an aromaticthio group, an heterocyclicthio and a halogen atom.

$R_{11}$ and $R_{21}$, $R_{11}$ and $R_{13}$, $R_{11}$ and $R_{14}$, $R_{12}$ and $R_{13}$, $R_{21}$ and $R_{22}$, $R_{21}$ and $R_{23}$, $R_{21}$ and $R_{24}$, and $R_{22}$ and $R_{23}$ may combine with each other to form a ring, respectively.

The substituent represented by $R_{11}$ or $R_{21}$ is preferably an aliphatic group, an aliphaticoxycarbonyl group or an aromaticoxycarbonyl group, and more preferably an aliphatic group.

The substituent represented by $R_{14}$ or $R_{24}$ is preferably a hydrogen atom or an aliphatic group, and more preferably a hydrogen atom.

The substituent represented by $R_{12}$, $R_{13}$, $R_{22}$ or $R_{23}$ is preferably a hydrogen atom or an aliphatic group, and more preferably a hydrogen atom.

The halogen atom represented by X is preferably a chlorine or bromine atom, and more preferably a chlorine atom.

The content of the compound represented by formula (I) or (II) in the silver halide color photographic light sensitive material of the invention is preferably 0.01 to 0.7 g/m$^2$ and more preferably 0.03 to 0.5 g/m$^2$.

Of diols represented by formula (I), the preferable is a compound represented by the following formula (I-a):

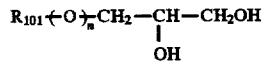

formula (I-a)

wherein $R_{101}$ represents an aliphatic group, an aromatic group or an acyl group; and n is 0 or 1.

Of halohydrins represented by formula (II), the preferable is a compound represented by the following formula (II-a) or (II-b):

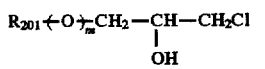

formula (II-a)

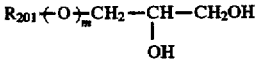

formula (II-b)

wherein $R_{201}$ represents an aliphatic group, an aromatic group or an acyl group; and m is 0 or 1.

The aliphatic, aromatic or acyl group represented by $R_{101}$ or $R_{201}$ of formula (I-a), (II-a) or (II-b) is the same as those denoted in $R_{11}$.

The exemplified compound of formula (I) or (II) will be shown below, but is not limited thereto.

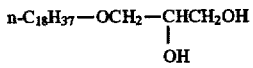
I-1
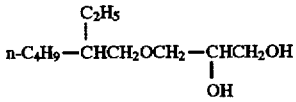
I-2
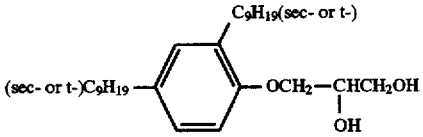
I-3
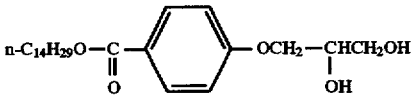
I-4
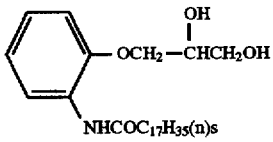
I-5
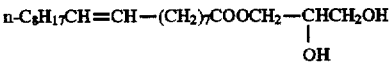
I-6
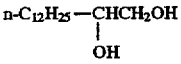
I-7
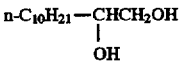
I-8
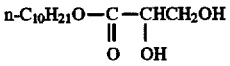
I-9
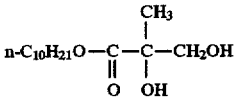
I-10
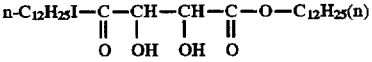
I-11
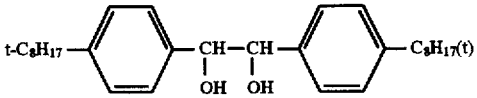
I-12
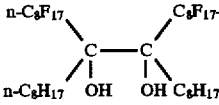
I-13
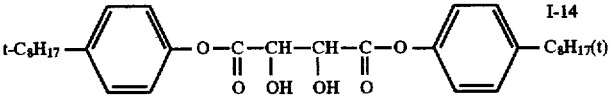
I-14
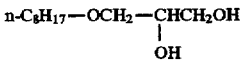
I-15
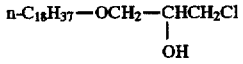
II-1
-continued
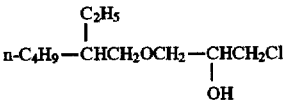
II-2
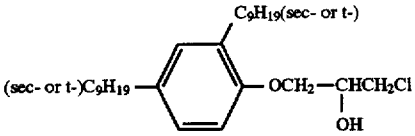
II-3
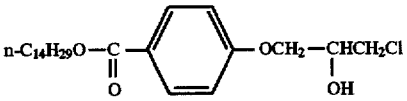
II-4
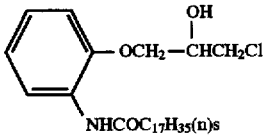
II-5
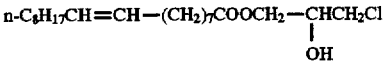
II-6
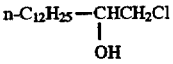
II-7
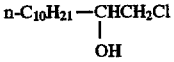
II-8
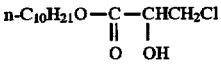
II-9
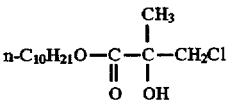
II-10
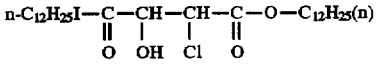
II-11
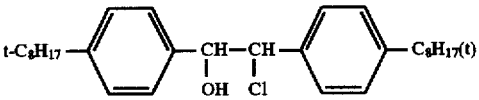
II-12
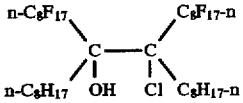
II-13
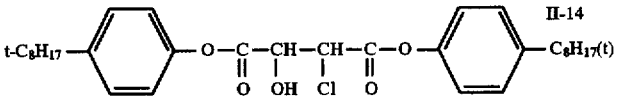
II-14
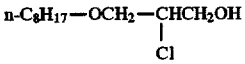
II-15
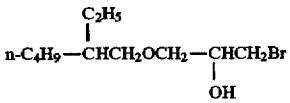
II-16

-continued

II-17

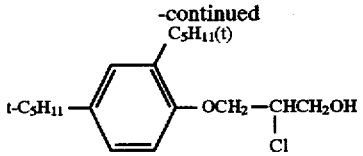

The content of the compound represented by formula (III), (IV) or (V) in the silver halide color photographic light sensitive material of the invention is preferably 0.05 to 1.0 g/m$^2$ and more preferably 0.1 to 0.5 g/m$^2$.

The example of a sparingly water soluble epoxy compound represented by formula (III), (IV) or (V) will be shown below. The example is not limited thereto. The "sparingly water soluble epoxy compound" herein referred to means a compound having a solubility of not more than 10 g, and preferably not less than 5 g, based on 100 g of distilled water at 25° C.

III-1

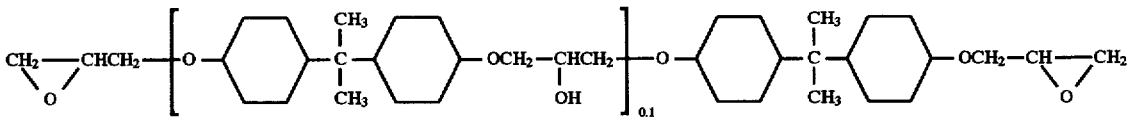

III-2

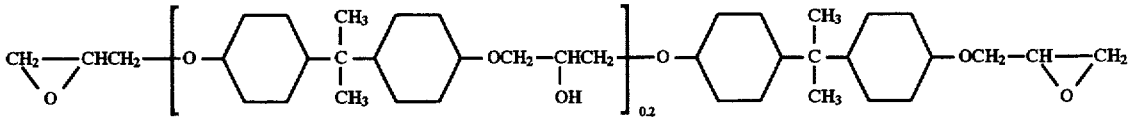

III-3

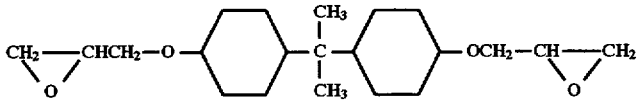

III-4

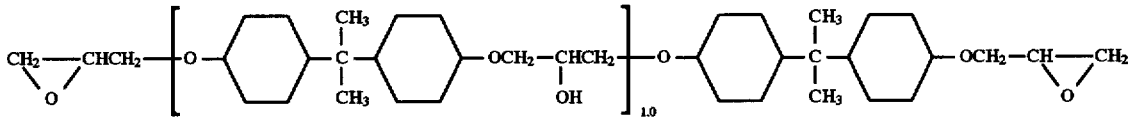

III-5

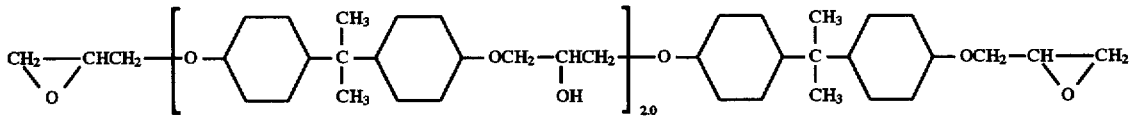

III-6

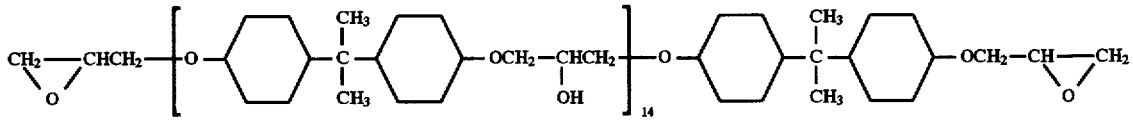

III-7

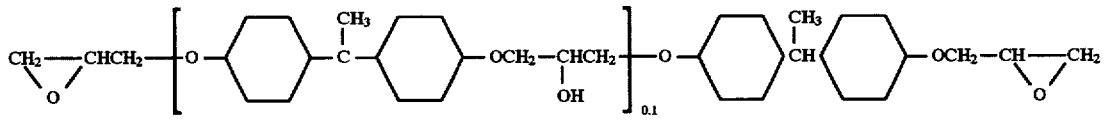

III-8

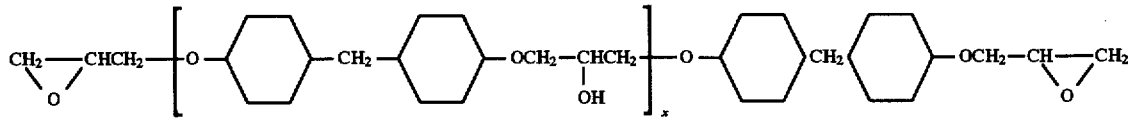

III-9

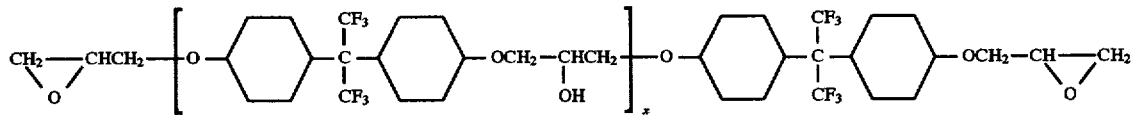

III-10

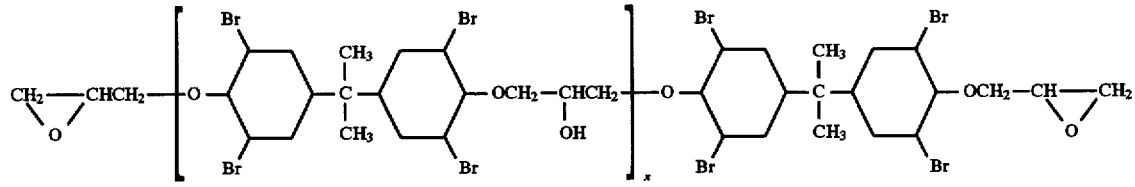

-continued
III-11
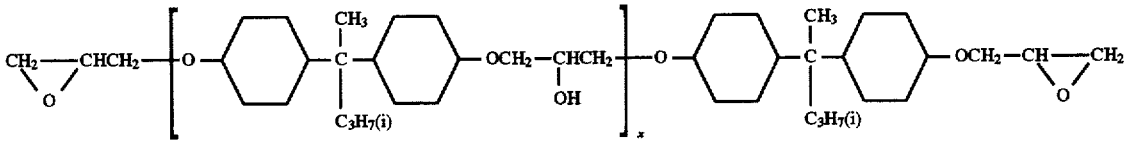
III-12
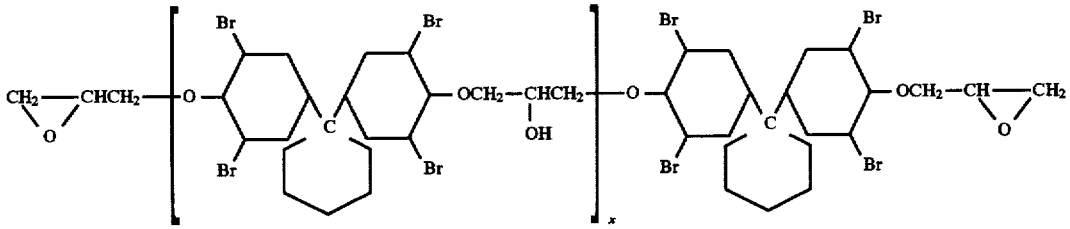
IV-1
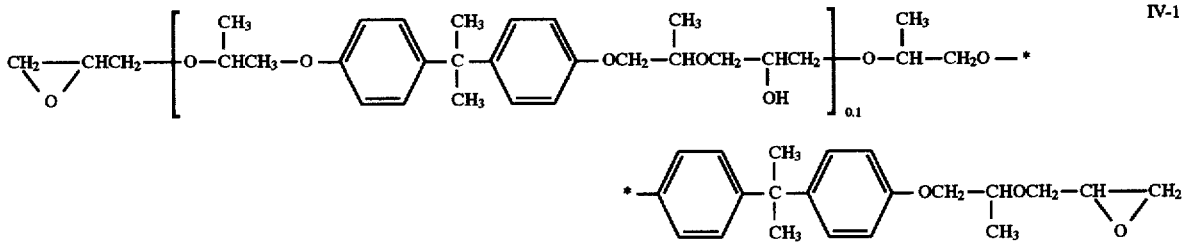
IV-2
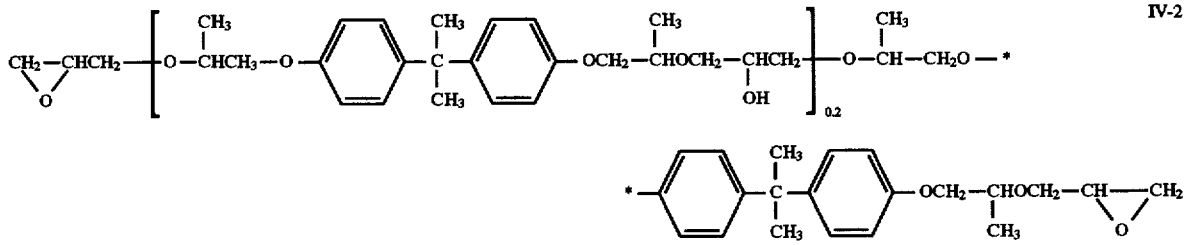
IV-3
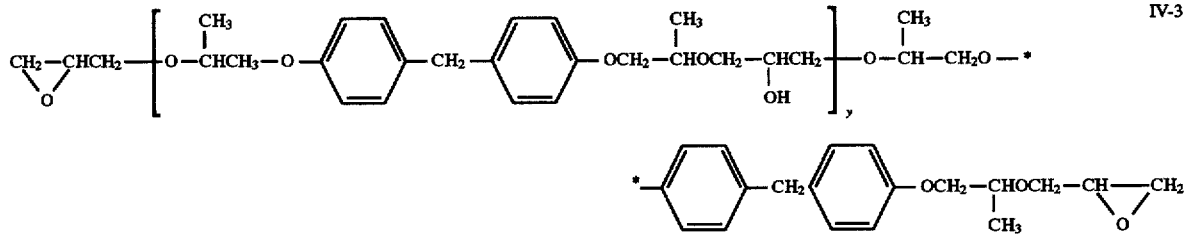
IV-4
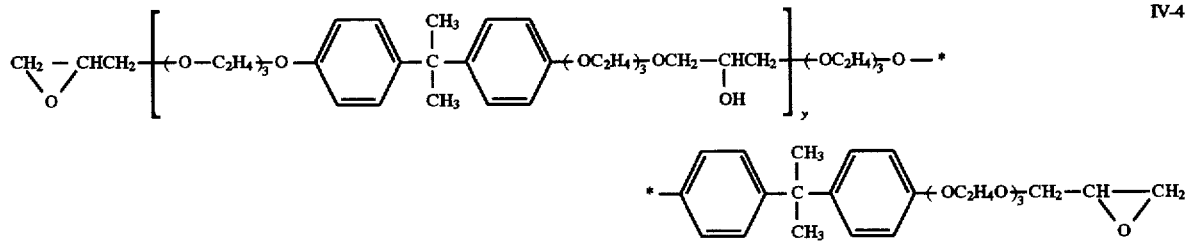
IV-5
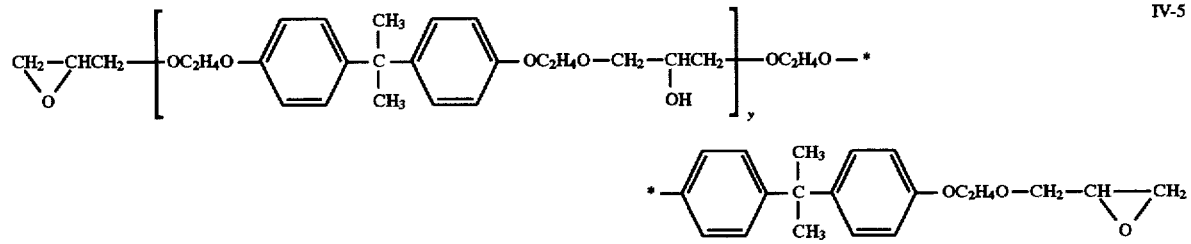

-continued

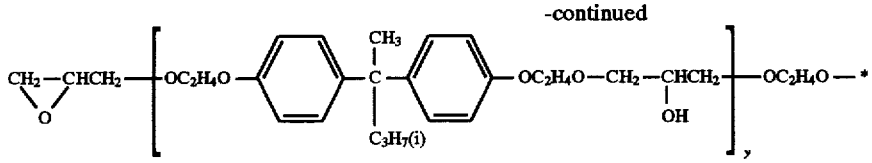

IV-6

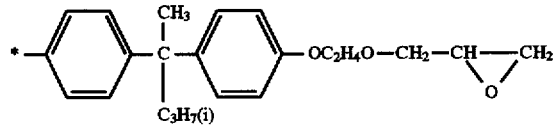

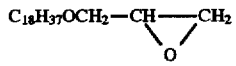

V-1

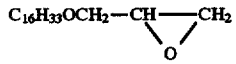

V-2

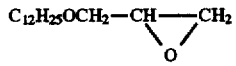

V-3

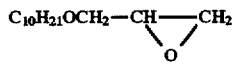

V-4

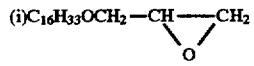

V-5

In the above formulas, x or y represents a real value of 0 to 20. The reason that x or y is not always an integer is that it shows an average value in a mixture of several compounds having different integers of x or y. The epoxy compound may be used singly or in combination or with a high boiling point solvent and/or a condensate besides the epoxy compound which is soluble in water and an organic solvent. The high boiling point solvent and condensate include those disclosed in Japanese Patent O.P.I. Publication No. 64-537/1989.

The epoxy compound in the invention is obtained by reacting a bisphenol A derivative with epichlorhydrin in the presence of sodium hydroxide. The epoxy compound is available on the market, and includes Rika resin HBE-100, DME-100, W-100, BPO-20E, BPO-60E (each produced by Shinnihon Rika Co., Ltd.), Adeca resin EP-4080, EP-4000, EP-4005 (each produced by Asahi Denka Co., Ltd.) and Epiol EH, SK (each produced by Nihon Yushi Co., Ltd.).

The compounds represented by formulas (I) through (V) in the invention can be added to a photographic component layer according to a conventional method. One method employs an oil-in water type method of dispersing oil in water, which is known as an oil protect method. When the compound is dispersed in water with a coupler, the compound content is preferably 0.01 to 1 mol based on mol of the coupler.

The silver halide composition may be any of silver chloride, silver bromide, silver bromochloride, silver bromoiodide, silver bromoiodochloride, and silver chloroiodide, but is preferably silver bromochloride containing 95 mol % of silver chloride and containing substantially no silver iodide. The silver bromochloride more preferably contains 97 mol % of silver chloride, and still more preferably contain 98 to 99.9 mol % of silver chloride.

In order to obtain such a silver halide emulsion, a silver halide emulsion comprising a high concentration of silver bromide is preferably used.

The above silver halide emulsion may be a silver halide emulsion layer comprising epitaxial depositions, so-called a core/shell emulsion, or a silver halide emulsion comprising in admixture silver halide grains different in halide composition. The silver halide grain composition may be varied continuously or discontinuously. The portions in which silver bromide comprises in a high concentration are especially preferable corners of the surface of silver halide crystals.

The silver halide grains advantageously contain a heavy metal ion. The heavy metal ion includes an ion of the eighth to tenth group metal in the periodic table such as iron, iridium, platinum, palladium, nickel, rhodium, osmium, ruthenium or cobalt, the twelfth group metal in the periodic table such as cadmium, zinc or mercury, lead, rhenium, molybdenum, tungsten, gallium or chromium. Of these, an iridium, platinum, ruthenium, gallium and osmium ion are preferable. These metal ions are preferably added to a silver halide emulsion in the form of their salts or complexes.

When the heavy metal ions form complexes, a ligand or ligand ion includes a cyanide ion, a thiocyanate ion, a cyanate ion, a chloride ion, a bromide ion, an iodide ion, a nitrate ion, carbonyl and ammonia. Of these, a cyanide ion, a thiocyanate ion, an isothiocyanate ion, a chloride ion and a bromide ion are preferable.

In order to incorporate the heavy metal ion into a silver halide emulsion, the heavy metal compound may be added before or during silver halide grain formation or during physical ripening after the silver halide grain formation. In order to obtain a silver halide emulsion meeting the above described, a solution containing the heavy metal compound and a halide in admixture may be added continuously during silver halide grain formation.

The addition amount of the heavy metal compound is preferably $1\times10^{-9}$ to $1\times10^{-2}$, more preferably $1\times10^{-8}$ to $1\times10^{-5}$ based on 1 mol of silver halide.

The silver halide grains may be of any shape. The preferable example is a cube having (100) face as a crystal surface. The silver halide grains having octahedron, tetradecahedron or dodecahedron prepared according to the descriptions described in U.S. Pat. Nos. 4,183,756 and 4,225,666, Japanese Patent O.P.I. Publication Nos. 55-26589/1980 and Japanese Patent No. 55-42737/1980 may be used. Further, the silver halide grains having twin plains may be used.

The silver halide grains used in the invention is preferably of single shape, but two or more kinds of monodispersed silver halide emulsions are preferably contained in the same silver halide emulsion layer.

The grain size of the silver halide emulsion is not specifically limited, but is preferably 0.1 to 1.2 μm, and more preferably 0.2 to 1.0. This grain size can be measured using a projected area of the grains or an approximate diameter. When the grains are uniform, the grain size distribution can be considerably correctly expressed in terms of a diameter or a protected area.

The silver halide grains are monodispersed grains having a grain size distribution of a variation coefficient of preferably 0.22 or less, and more preferably 0.15 or less. Especially preferably, two or more kinds of the monodispersed grains having a grain size distribution of a variation coefficient of 0.15 or less are incorporated in the same silver halide emulsion layer. Herein, a variation coefficient shows the broadness of the grain size distribution, and is defined as the following expression:

$$\text{Variation coefficient}=S/R,$$

wherein S represent a standard deviation of grain size distribution; and R represent an average grain size.

Herein, when the grains are spherical, grain size represents a diameter, and when the grains are cubic or not spherical, grain size represents a diameter of a circle corresponding to a projected area of the grains.

As an apparatus and a method for preparing silver halide emulsions, various conventional ones known in the field can be used.

The silver halide emulsions of the present invention may be prepared through any of those including an acid process, a neutral process and an ammonia process. Aforesaid grains may be grown directly, or may be grown after producing seed grains. A method for producing seed grains and a method for growing them may be the same or different.

In addition, as a method to cause soluble silver salt and a soluble halogenated salt to react, any of a normal precipitation method, a reverse precipitation method, a double-jet method and combination thereof are allowed. Of them, those obtained through a double-jet method is desirable. In addition, as one type of a double-jet method, pAg-controlled double jet method described in Japanese Patent O.P.I. Publication No. 48521/1979 can also be used. O.P.I. Publication Nos. 92523/1982 and 92524/1982 wherein water-soluble silver salt and water-soluble halogenated compound salt aqueous solution is fed from an addition device placed in an initial solution for reaction, an apparatus disclosed in German Patent No. 2921164 wherein the concentration of water-soluble silver salt and water-soluble halogenated compound salt aqueous solution is continuously changed for adding, or an apparatus disclosed in Japanese Patent Publication No. 501776/1981 wherein grains are formed while the distance between each silver halide grain is kept constant by taking an initial solution outside of a reactor and concentrating it by the use of a ultra filtration method may be used.

In addition, if necessary, silver halide solvents such as thioether may be used. In addition, compounds having a mercapto group and compounds such as nitrogen-containing heterocycles or sensitizing dyes may be used by adding during formation of silver halide grains or after completion of forming grains.

The silver halide emulsion may be sensitized by the use of sensitizing methods using gold compounds and sensitizing methods using chalcogen sensitizers in combination.

As chalcogen sensitizers applicable, sulfur sensitizers, selenium sensitizers and tellurium sensitizers can be used. Among them, sulfur sensitizers are desirable. As sulfur sensitizers, thiosulfate, allylthiocarbamidothiourea, allylisothiacyanate, cystine, p-toluenethiosulfonate salt, rhodanine and an inorganic sulfur are cited.

The added amount of sulfur sensitizers is different depending upon the kind of silver halide emulsion and intended effects, preferably $5\times10^{-10}$ to $5\times10^{-5}$ mol per mol of silver halide, and more preferably $5\times10^{-8}$ to $3\times10^{-5}$ mol per mol of silver halide.

The gold sensitizers applicable can be added in the form of gold chloride, silver chloride, gold sulfide, gold thiosulfate and various gold complex. As compounds to be used therein, dimethylrhodanine, thiocyanate, mercaptotetrazole and mercaptotriazole are cited. The added amount of gold compounds is different depending upon the kind of silver halide emulsion, kind of compounds used and ripening conditions, preferably $1\times10^{-4}$ to $1\times10^{-8}$ mol per mol of silver halide, and more preferably $1\times10^{-5}$ to $1\times10^{-8}$ mol per mol of silver halide.

As chemical sensitizing of the silver halide emulsion reduction sensitizing may be carried out.

In the silver halide emulsion, conventional anti-foggants and stabilizers can be used for preventing fog which occurs during preparation step of a silver halide photographic light-sensitive material, for reducing fluctuation in properties during storage and preventing fog which occurs when being developed. As an example of compounds used for such purposes, compounds represented by formula (II) described in the lower column on page 7 of Japanese Patent O.P.I. Publication No. 146036/1990 are cited. Practical examples thereof are compounds (IIa-1) through (IIa-8) and (II-b) through (IIb-7), 1-(3-methoxyphenyl)-5-mercaptotetrazole and 1-(4-ethoxyphenyl)-5-mercaptotetrazole are cited. These compounds are added, depending upon their purposes, in a preparation step, in a chemical sensitization step, at the end of chemical sensitization step and in a preparation step for a coating solution. When chemical sensitization is carried out in the presence of these compounds, the addition amount of these compounds are preferably $1\times10^{-5}$ to $5\times10^{-4}$ per 1 mol of silver halide. When these compounds are added after completion of chemical sensitization, the addition amount of these compounds are preferably $1\times10^{-6}$ to $1\times10^{-2}$, and more preferably $1\times10^{-5}$ to $5\times10^{-3}$ per 1 mol of silver halide. When these compounds are added to the silver halide emulsion during preparation of the coating solution, the addition amount of these compounds are preferably $1\times10^{-6}$ to $1.\times10^{-1}$, and more preferably $1\times10^{-5}$ to $1\times10^{-2}$ per 1 mol of silver halide. When these compounds are added to coating layers other than silver halide emulsion layers, the content in the coating layer of these compounds are preferably $1\times10^{-9}$ to $1\times10^{-3}$ per $m^2$ of the coating layer.

To the silver halide photographic light-sensitive materials of the present invention, dyes having absorption ability for various wavelength can be used for preventing irradiation and halation. The conventional dyes can be used, and, dyes AI-1 to AI-11 described in Japanese Patent O.P.I. Publication No. 3-251840/1991, page 308 or dyes described in Japanese Patent O.P.I. Publication No. 6-3770/1994 are preferably used, as dyes having an absorption in the visible light wavelength region. The dyes represented by the general formula (I), (II) or (III) described in Japanese Patent O.P.I.

Publication No. 1-280750/1989, page 2, lower left side are preferably used as infrared absorption dyes which have preferable spectral characteristic, in view of no adverse affect on photographic properties of photographic emulsions or staining due to remaining color. The preferable examples includes exemplified compounds (1) through (45) described in Japanese Patent O.P.I. Publication No. 1-280750/1989, page 3, lower left side through page 5, lower left side.

The addition amount of these dyes is preferably an amount necessary to give a spectral reflective density at 680 nm of preferably 0.5 or more, and more preferably 0.8 or more in non-processed light sensitive material, in view of sharpness improvement.

The light sensitive material preferably contains a brightening agent in view of white background improvement. The brightening agent preferably includes the compound represented by formula II described in Japanese Patent O.P.I. Publication No. 2-2326520/1990.

The light sensitive material of the invention includes a silver halide emulsion layer containing a yellow coupler, a magenta coupler and a cyan coupler in combination, which is sensitized in the specific range of 400 to 900 nm. The silver halide emulsion layer comprises one or more sensitizing dyes.

The sensitizing dyes used are any conventional dyes. As a blue sensitive sensitizing dye, dyes BS-1 through BS-8 described in Japanese Patent O.P.I. Publication No. 3-251840/1991, page 28 are preferably used singly or in combination. As a green sensitive sensitizing dye, dyes GS-1 through GS-5 described in the same Japanese Patent O.P.I. Publication, page 28 are preferably used, and as a red sensitive sensitizing dye, dyes RS-1 through RS-8 described in the same Japanese Patent O.P.I. Publication, page 29 are preferably used. When imagewise exposure is carried out using an infrared light such as a semi-conductor laser, an infrared sensitizing dye needs to be used. In such case, as an infrared sensitive sensitizing dye, dyes IRS-1 through IRS-11 described in Japanese Patent O.P.I. Publication No. 4-285950/1992, pages 6 to 8 are preferably used. In addition to these infrared, red, green and blue sensitizing dyes, super sensitizers SS-1 through SS-9 described in Japanese Patent O.P.I. Publication No. 4-285950/1992, pages 8 to 9 or compounds S-1 through S-17 described in Japanese Patent O.P.I. Publication No. 5-66515/1993, pages 15 to 17 are preferably used in combination.

These sensitizing dyes are added in any step from silver halide grain formation to completion of chemical sensitization. The sensitizing dyes are added to the silver halide emulsion in the form of solution, in which the dyes are dissolved in water or a water-miscible organic solvent such as methanol, ethanol, fluorinated alcohol, acetone or dimethylformamide or their solid dispersion.

The coupler used in the silver halide photographic light sensitive material of the invention may be any compound which can produce a coupling product having a spectral absorption maximum of 340 nm or longer on coupling reaction with an oxidation product of a color developing agent. As the typical coupler are known a coupler for forming a yellow dye having a spectral absorption maximum in a wavelength of 350 to 500 nm, a coupler for forming a magenta dye having a spectral absorption maximum in a wavelength of 500 to 600 nm and a coupler for forming a cyan dye having a spectral absorption maximum in a wavelength of 600 to 750 nm.

The cyan coupler used in the silver halide photographic light sensitive material the invention includes a coupler represented by formula (C-I) or (C-II) described in left lower column on page 5 of Japanese Patent O.P.I. Publication No. 4-114154/1992, and the exemplified compound is a coupler represented by formula (CC-1) or (CC-9) described in page 5, right lower column to page 6, left lower column of the same. The preferable is a coupler represented by formula (C-1).

The magenta coupler used in the silver halide photographic light sensitive material the invention includes a magenta coupler represented by formula (M-I) or (M-II) described in right upper column on page 4 of Japanese Patent O.P.I. Publication No. 4-114154/1992, and the exemplified compound is a coupler represented by formula (MC-1) or (MC-11) described in page 4, left lower column to page 5, right upper column of the same. Of the above magenta couplers, the preferable is a coupler represented by formula (M-I) described on page 4, right upper column of the same, and a coupler in which $R_M$ is a tertiary alkyl group in formula (M-I) is especially preferable in excellent light fastness. The couplers, MC-8 through MC-11 on page 4, upper column of the same are especially preferable, in that the couplers give excellent color reproduction of blue to violet and red and excellent image reproduction.

The yellow coupler used in the silver halide photographic light sensitive material the invention includes a yellow coupler represented by formula (Y-I) described in right upper column on page 3 of Japanese Patent O.P.I. Publication No. 4-114154/1992, and the exemplified compound is a coupler represented by formula (YC-1) or (YC-9) described on page 3, left lower column and thereafter. The coupler in which $RY_1$ is an alkoxy group in formula (Y-1) of the same or a coupler represented by formula (I) described in Japanese Patent O.P.I. Publication No. 6-67388/1994 is preferable in excellent yellow color reproduction. Of the above couplers, the preferable are a coupler represented by formula YC-8 or YC-9 described on page 4, right lower column of Japanese Patent O.P.I. Publication No. 4-114154/1992 and couplers, No. (1) through No. (47) on pages 13 and 14 of Japanese Patent O.P.I. Publication No. 6-67388/1994. The more preferable are couplers represented by formula (Y-1) described on page 1 and pages 11 through 17 of Japanese Patent O.P.I. Publication No. 4-81847/1992.

When a coupler or another organic compound is added to the silver halide photographic light sensitive material in the invention using an oil in water type emulsifying method, the coupler is usually dissolved in a water-insoluble, high boiling point organic solvent having a boiling point of 150° C. or more, a low boiling point and/or water soluble organic solvent being optionally added, the solution is added to a hydrophilic binder solution such as a gelatin solution, and then emulsified using a surfactant. The emulsifying means includes a stirrer, a homogenizer, a colloid mill, a flow-jet mixer and a ultrasonic emulsifier. The process removing a low boiling point organic solvent may be added during or after the emulsification. As a high boiling point organic solvent used for dissolving and emulsifying a coupler, phthalates such as dioctyl phthalate, diisodecyl phthalate and dibutyl phthalate or phosphates such as tricresyl phosphate and trioctyl phosphate are preferable. The dielectric constant of the high boiling point solvent is preferably 3.5 to 7.0. Two or more high boiling point solvents can be used in combination.

Beside the method employing a high boiling point organic solvent, a method is used in which a water insoluble,.organic solvent soluble polymer are dissolved in a high boiling point organic solvent and optionally in a low boiling point and/or water soluble organic solvent and emulsified in a hydrophilic binder solution such as a gelatin solution, using a surfactant. The water insoluble and organic solvent soluble polymer includes poly(N-t-butylacrylamide).

The preferable surfactant used in dispersing photographic additives or adjusting surface tension includes compounds which have a hydrophobic group with 8 to 30 carbon atoms and a sulfonic acid group or its salt group in a molecule. The examples include compounds A-1 to A-11 described in Japanese Patent O.P.I. Publication No. 62-26854/1987. The surfactant having a fluorinated alkyl group is preferably used. The dispersion solution of the compounds is usually added to a coating solution containing a silver halide emulsion. The time between their dispersion and their addition to the coating solution or the time between their addition and the coating is preferably shorter, each being preferably 10 hours or less, more preferably 3 hours or less and still more preferably 20 minutes or less.

The anti-fading additive is preferably added to each coupler layer in order to prevent discoloration of a formed dye image due to light, heat or humidity. The especially preferable compounds include phenylether compounds represented by formulas I to II described in Japanese Patent O.P.I. Publication No. 2-66541/1990, 3 page, phenol compounds A-1 to A-11 represented by formula IIIB described in Japanese Patent O.P.I. Publication No. 3-174150/1987, amine compounds represented by formula A described in Japanese Patent O.P.I. Publication No. 64-90445/1989, and metal complexes represented by formula XII, XIII, XIV or XV described in Japanese Patent O.P.I. Publication No. 62-182741/1987, which are preferable especially for a magenta dye. The compounds represented by formula I' described in Japanese Patent O.P.I. Publication No. 1-196049/1989 or compounds represented by formula II described in Japanese Patent O.P.I. Publication No. 5-11417/1993 are preferable for a yellow or cyan dye.

For the purpose of shifting an absorption wavelength of a color dye compound (d-11) described on pages 33 and compound (A'-1) described on pages 35 of Japanese Patent O.P.I. Publication No. 4-114154/1992 can be used. Besides the compounds, a fluorescent dye releasing compound disclosed in U.S. Pat. No. 4,774,187 are used.

The compound capable of reacting with an oxidation product of a color developing agent is preferably added to the layers between the two silver halide emulsion layers to prevent color mixture or to the silver halide emulsion layers to restrain fog. The compounds include preferably hydroquinone derivatives, more preferably dialkylhydroquinone such as 2,5-di-t-octylhydroquinone. The especially preferable. compounds includes a compound represented by formula II described in Japanese Patent O.P.I. Publication No. 4-133056/1992, and compounds II-1 through II-14 on pages 13 and 14 and compound 1 described on page 17, of the same Japanese Patent.

The UV absorber is preferably added to light sensitive material to restrain static fog or to improve light fastness of a formed dye image. The preferable UV absorber includes benzotriazoles, and more preferably a compound represented by formula III-3 described in Japanese Patent O.P.I. Publication No. 1-250944/1989, a compound represented by formula III described in Japanese Patent O.P.I. Publication No. 64-66646/1989, UV-1L through UV-27L described in Japanese Patent O.P.I. Publication No. 63-187240/1988, a compound represented by formula I described in Japanese Patent O.P.I. Publication No. 4-1633/1992, and a compound represented by formula (I) or (II) described in Japanese Patent O.P.I. Publication No. 5-165144/1993.

For the silver halide photographic light-sensitive materials, it is advantageous to use gelatin as a binder. In addition, other gelatins, gelatin derivatives, graft polymers between gelatin and other polymers, proteins other than gelatin, sugar derivatives, cellulose derivatives and hydrophilic colloid such as synthetic hydrophilic polymers including homopolymers or copolymers can also be used if necessary.

The hardeners for a binder may be used. As hardeners, vinylsulfone type hardeners and chlorotriazine type hardeners are preferably used singly or in combination. The compounds described in Japanese Patent O.P.I. Publication Nos. 61-249054/1986 and 61-245153/1986 are preferably used. The antiseptic agent or anti-fungal described in Japanese Patent O.P.I. Publication No. 3-157646/1991 are preferably added to the colloid layer in order to prevent breed of bacilli or fungi which adversely affects photographic properties or image storage stability. The lubricant or matting agent described in Japanese Patent O.P.I. Publication Nos. 6-118543/1994 and 2-73250/1990 is preferably added to a protective layer in order to improve surface property of the non-processed or processed light sensitive material.

The support used in the color light sensitive material of the invention may be any material, and includes papers covered with polyethylene or polyethylene terephthalate, paper supports made of natural or synthetic pulp, a polyvinyl chloride sheet, polypropylene containing a white pigment, polyethyleneterephthalate support and baryta papers. The support comprising a paper and a water-proof resin layer provided on each side thereof is preferable. The water-proof resin preferably is polyethylene, polyethyleneterephthalate or their copolymer.

As white pigments to be used for the support, inorganic and/or organic white pigments can be used. The preferred are inorganic white pigments. For example, sulfate of alkaline earth metals such as barium sulfate, carbonate salts of alkaline earth metals such as calcium carbonate, silica such as fine silicate and synthetic silicate, calcium silicate, alumina, alumina hydrate, titanium oxide, zinc oxide, talc and clay are cited. The preferred white pigments are barium sulfate and titanium oxide.

The amount of white pigment contained in the water-proof resin layer on the surface of the support is preferable to be not less than 13% by weight, and more preferable to be not less than 15% by weight, in view of improved image sharpness.

The degree of dispersion of white pigment in the water-proof resin layer on a paper support used can be measured by means of a method described in Japanese Patent O.P.I. Publication No. 28640/1990. When measured by means of this method, the degree of dispersion of white pigment is preferable to be not more than 0.20, and more preferable to be not more than 0.15 in terms of fluctuation coefficient described in the aforesaid specification, in view of improved gloss. The white pigment containing water-proof resin layer of a paper support or hydrophilic colloid layer coated on a paper support preferably contains a bluing agent or reddening agent such as ultramarine or oil-soluble dyes in order to adjust a reflective density balance of white background after processing and to improve whiteness.

After the surface of the support is provided with corona discharge, UV ray irradiation and firing treatment if necessary, a light-sensitive materials may be coated directly or through subbing layers (one or two or more subbing layer in order to improve adhesiveness, anti-static property stability in sizing, anti-abrasion property, stiffness, anti-halation property, abrasion property and/or other properties of the surface of the support.)

When a light-sensitive materials using silver halide emulsions is coated, a thickener may be used. As coating methods, an extrusion coating method and a curtain coating method is especially advantageous because they can coat 2 or more layers concurrently.

An image forming method employing the color light sensitive material of the invention includes a method comprising printing on a photographic paper an image formed on a negative, a method comprising converting an image to digital information, displaying the image from the information on a CRT (cathode ray tube), and then printing the displayed image on a photographic paper, and a method comprising printing an image on a photographic paper by scanning a laser light which strength is varied based on digital information.

The invention is applied to preferably a light sensitive material containing no color developing agent, and more preferably a light sensitive material capable of forming an image for direct appreciation. The example includes color paper, color reversal paper, a light sensitive material capable of forming a positive image, a light sensitive material for display and a light sensitive material for color proof. The invention is applied to especially preferably a light sensitive material having a reflective support.

The aromatic primary amine color developing agents used in the present invention include a conventional compound. The examples will be shown below.

CD-1: N,N-Diethyl-p-phenylenediamine
CD-2: 2-Amino-5-diethylaminotoluene
CD-3: 2-Amino-5-(N-ethyl-N-laurylamino)toluene
CD-4: 4-(N-ethyl-N-β-hydroxyethyl)aminoaniline
CD-5: 2-Methyl-4-(N-ethyl-N-β-hydroxyethyl) aminoaniline
CD-6: 4-amino-3-methyl-N-ethyl-N-(β-methanesulfonamidoethyl)aniline
CD-7: 4-amino-3-(β-methanesulfonamidoethyl)-N,N-diethylaniline
CD-8: N,N-Dimethyl-p-phenylenediamine
CD-9: 4-Amino-3-methyl-N-ethyl-N-methoxyethylaniline
CD-10: 4-Amino-3-methyl-N-ethyl-N-(β-hydroxyethyl) aniline
CD-11: 4-Amino-3-methyl-N-ethyl-N-(γ-hydroxypropyl) aniline In the invention the pH of color developer may be any, but preferably within the range of 9.5 to 13.0, and more preferably within the range of 9.8 to 12.0 in view of rapid processing.

The color developing temperature is preferably 35° to 70° C. The temperature is preferably higher in view of shorter processing time, but is preferably not so high in view of processing stability. The developing is carried out at preferably 37° to 60° C.

The color developing is carried out ordinarily in about 3.5 minutes. The color developing is carried out preferably in not more than 40 seconds, and more preferably in not more than 25 seconds, in view of rapid processing.

The color developer may contain conventional developing components in addition to the above color developer. The developing components include an alkaline agent having a buffer effect, a chloride ion or a developing inhibitor such as benzotriazole, a preservative and a chelating agent.

The light sensitive material in the invention is color developed, and then bleach-fixed with bleach-fixer. The bleach-fixer used in the invention contains an iron complex in an amount of preferably 30 to 120 g/liter, and more preferably 50 to 100 g/liter. The bleach-fixer used in the invention contains a silver ion in an amount of 0.04 to 0.11 mol per liter and an iron complex consisting of 5 to 35% of an iron (II) complex and an iron (III) complex. Such a bleach-fixer is obtained after a light sensitive material comprising silver in an amount of 0.4 to 1.0 g/m$^2$ is running processed by one round or more, a bleach-fixer replenisher being replenished to a bleach-fixer in an amount of not more than 100 ml/m$^2$. The term "one round" herein referred to means that when the bleach-fixer replenisher is replenished to the bleach-fixer in an amount of not more than 100 ml/m$^2$, the total replenishing amount is the same amount as the bleach fixer tank volume. In the invention, the replenishing amount of the bleach-fixer replenisher is preferably not more than 100 ml/m$^2$ of light sensitive material and more preferably 20 to 100 ml/m$^2$ of light sensitive material. The bleach-fixer has a pH of preferably 5.0 to 6.5, and bleach-fixing is carried out at preferably 30° to 60° C.

The iron complex includes an iron complex of an amino polycarboxylic acid, which is preferably used in the form of an iron complex of an amino polycarboxylic acid (free acid) represented by the following Formula (I) and the iron complex is more preferably used in combination with the amino polycarboxylic acid (free acid). It is especially preferable that the iron complex is used in combination with the same acid as the amino polycarboxylic acid (free acid) constituting the complex. The salt such as a potassium, sodium or ammonium salt of the iron complex of an amino polycarboxylic acid can be also used. The salt such as a potassium or sodium salt of the amino polycarboxylic acid can be also used.

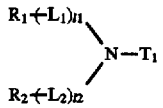

Formula (I)

wherein $T_1$ represents a hydrogen atom, a hydroxy group, a carboxy group, a sulfo group, a carbamoyl group, a phosphono group, a phosphon group, a sulfamoyl group, a substituted or unsubstituted alkyl group, an alkoxy group, an alkylsulfonamido group, an alkylthio group, an acylamino group or a hydroxamic acid group, a hydroxyalkyl group or

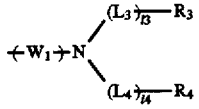

wherein $W_1$ represents a substituted or unsubstituted alkylene, arylene, alkenylene, cycloalkylene or aralkylene group or

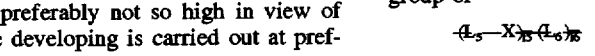

wherein X represents —O—, —S—, a divalent heterocyclic group or

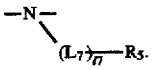

In Formula (I), $R_1$ through $R_5$ independently represent a hydrogen atom, a hydroxy group, a carboxy group, a sulfo group, a carbamoyl group, a phosphono group, a phosphon group, a sulfamoyl group, a sulfonamido group, an acylamino group or a hydroxmic acid group, provided that at least one of $R_1$ through $R_5$ is a carboxy group. L1 through L7 independently represent a substituted or unsubstituted alkylene, arylene, alkenylene, cycloalkylene or aralkylene group; and $l_1$ through $l_7$ independently represent an integer of 0 to 6, provided that $l_5$ through $l_6$ are not simultaneously 0.

The example of the amino polycarboxylic acid represented by Formula (I) is listed below.

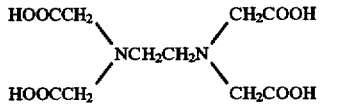
I-1

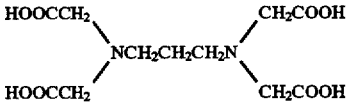
I-2

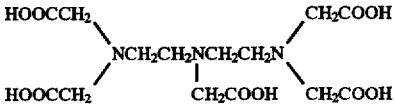
I-3

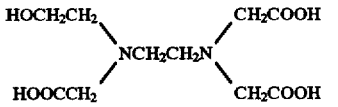
I-4

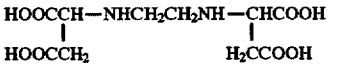
I-5

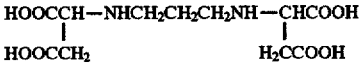
I-6

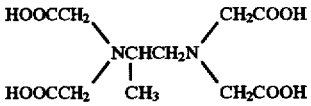
I-7

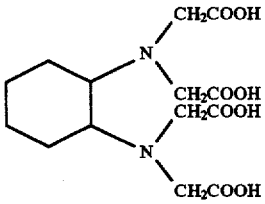
I-8

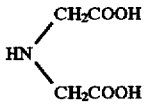
I-9

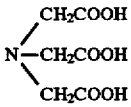
I-10

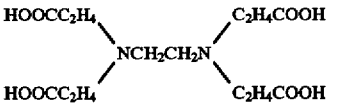
I-11

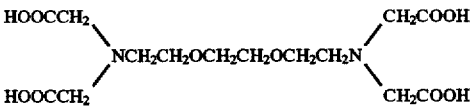
I-12

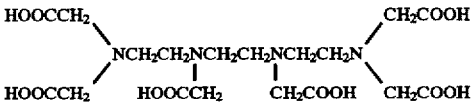
I-13

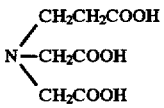
I-14

-continued

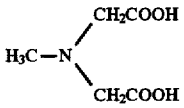
I-15

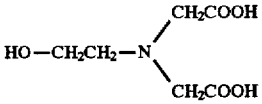
I-16

Of these examples, the preferable are I-1, I-2, I-3 or I-5.

After the bleach-fixing, washing is usually carried out. Stabilizing may be carried out instead of washing. The developing apparatus using development of light sensitive material may be a roller transport type which transports the light sensitive material sandwiched between the rollers or an endless belt type which transports the light sensitive material fixed on the belt. As a processing method is used a method of feeding light sensitive material and a processing solution into a slit-shaped processing tank, a method of processing light sensitive material jetting a processing solution, a web method of contacting light sensitive material with a carrier impregnated with a processing solution or a method of processing light sensitive material with a viscous processing solution. A large amount of light sensitive materials are usually running processed using an automatic processor. The replenishing amount of replenisher is preferably small, and the replenishing is most preferably carried out using replenisher tablets in view of environmental property. The replenishing method is most preferably a method described in Journal of Technical Disclosure 94-16935.

The invention will be explained according to the following examples, but is not limited thereto.

EXAMPLE 1

On both sides of paper pulp having a weight of 180 g/m$^2$, there was laminated high density polyethylene to prepare a paper support. However, on a side on which emulsion layers are coated, a fused polyethylene provided with surface treatment containing dispersed anatase type titanium oxide in an amount of 15 weight % was laminated to prepare a reflection support. This reflection support was subjected to corona discharge, and was coated with a gelatin subbing layer. On the subbing layer, each layer shown below was coated to prepare a silver halide color photographic light-sensitive material Sample. The coating solution was prepared as shown in the following:

To 23.4 g of yellow coupler (Y-1), 3.34 g of each of dye image stabilizers (ST-1), (ST-2) and (ST-5), 0.34 g of anti-stain agent (HQ-1), 5.0 g of image stabilizing agent A, 5.00 g of high boiling organic solvent (DBP) and 1.67 g of high boiling organic solvent (DNP), 60 ml of ethyl acetate were added and dissolved. The solution was emulsified and dispersed into 220 ml of a 10% aqueous gelatin solution containing 7 ml of 20% surfactant (SU-1) by the use of a supersonic homogenizer to prepare yellow coupler dispersion solution. This dispersion solution was mixed with the blue sensitive silver halide emulsion prepared according to the following to prepare a coating solution for the first layer.

The 2nd layer through the 7th layer were prepared to have a coating amount as shown in Tables 1 and 2 in the same manner as in the above-mentioned coating solution for the 1st layer.

In addition, as a hardener, (H-1) and (H-2) were added. As a coating aid, surfactants SU-2 and SU-3 were added to adjust a surface tension. Further, (F-1) was added in a total amount of 0.04 g/m$^2$.

TABLE 1

| Layer | Structure | Added amount ($g/m^2$) |
|---|---|---|
| 7th layer (Protective layer) | Gelatin | 1.00 |
| | DBP | 0.002 |
| | DIDP | 0.002 |
| | Silicone dioxide | 0.003 |
| 6th layer (UV absorbing layer) | Gelatin | 0.40 |
| | AI-1 | 0.01 |
| | UV absorber (UV-1) | 0.12 |
| | UV absorber (UV-2) | 0.04 |
| | UV absorber (UV-3) | 0.16 |
| | Anti-stain Agent (HQ-5) | 0.04 |
| | PVP | 0.03 |
| 5th layer (Red sensitive layer) | Gelatin | 1.30 |
| | Red sensitive silver bromochloride emulsion (Em-R) | 0.21 |
| | Cyan coupler (C-1) | 0.25 |
| | Cyan coupler (C-2) | 0.08 |
| | Dye image stabilizer (ST-1) | 0.10 |
| | Anti-stain agent (HQ-1) | 0.004 |
| | DBP | 0.10 |
| | DOP | 0.20 |
| 4th layer (UV absorbing layer) | Gelatin | 0.94 |
| | UV absorber (UV-1) | 0.28 |
| | UV absorber (UV-2) | 0.09 |
| | UV absorber (UV-3) | 0.38 |
| | AI-1 | 0.02 |
| | Anti-stain agent (HQ-5) | 0.10 |

TABLE 2

| Layer | Structure | Added amount ($g/m^2$) |
|---|---|---|
| 3rd layer (Green sensitive layer) | Gelatin | 1.30 |
| | AI-2 | 0.01 |
| | Green sensitive silver bromochloride emulsion (Em-G) | 0.14 |
| | Magenta coupler (M-1) | 0.20 |
| | Dye image stabilizer (ST-3) | 0.20 |
| | Dye image stabilizer (ST-4) | 0.17 |
| | DIDP | 0.13 |
| | DNP | 0.13 |
| 2nd layer (Intermediate layer) | Gelatin | 1.20 |
| | AI-3 | 0.01 |
| | Anti-stain agent (HQ-2) | 0.03 |
| | Anti-stain agent (HQ-3) | 0.03 |
| | Anti-stain agent (HQ-4) | 0.05 |
| | Anti-stain agent (HQ-5) | 0.23 |
| | DIDP | 0.04 |
| | DBP | 0.02 |
| | Fluorescent brightening agent (W-1) | 0.10 |
| 1st layer (Blue sensitive layer) | Gelatin | 1.20 |
| | Blue sensitive silver bromochloride emulsion (Em-B) | 0.26 |
| | Yellow coupler (Y-1) | 0.70 |
| | Dye image stabilizer (ST-1) | 0.10 |
| | Dye image stabilizer (ST-2) | 0.10 |
| | Anti-stain agent (HQ-1) | 0.01 |
| | Dye image stabilizer (ST-5) | 0.10 |
| | Image stabilizer A | 0.15 |
| | DNP | 0.05 |
| | DBP | 0.15 |
| Support | Paper laminated with polyethylene (containing minute colorant) | |

The added amount of the silver halide emulsion is illustrated in terms of silver.

SU-1: Sodium tri-i-propylnaphthalene sulfonate

SU-2: Sodiumsulfo di(2-ethylhexyl)succinate

SU-3: Sodiumsulfo di(2,2,3,3,4,4,5,5-octafluoropentyl) succinate

DBP: Dibutylphthalate

DNP: Dinonylphthalate

DOP: Dioctylphthalate

DIDP: Diisodecylphthalate

PVP: Polyvinylpyrrolidone

H-1: Tetrakis(vinylsulfonylmethyl)methane

H-2: Sodium 2,4-dichloro-6-hydroxy-s-triazine

HQ-1: 2,5-Di-t-octylhydroquinone

HQ-2: 2,5-Di-sec-dodecylhydroquinone

HQ-3: 2,5-Di-sec-tetradecylhydroquinone

HQ-4: 2-Sec-dodecyl-5-sec-tetradecylhydroquinone

HQ-5: 2,5-Di-(1,1-dimethyl-4-hexyloxycarbonyl) butylhydroquinone

Image stabilizing agent A: p-Octylphenol

Y-1

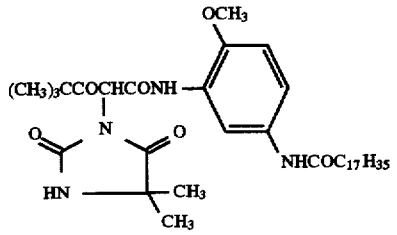

M-1

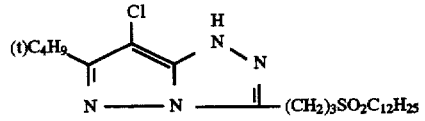

-continued
C-1
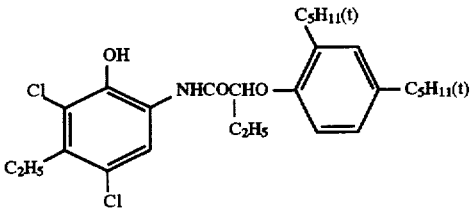
C-2
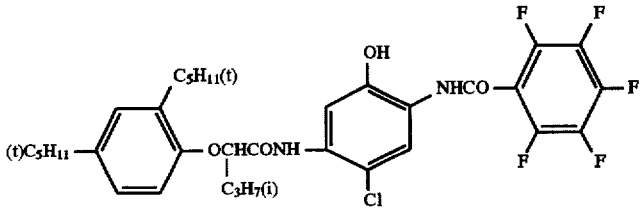
ST-1
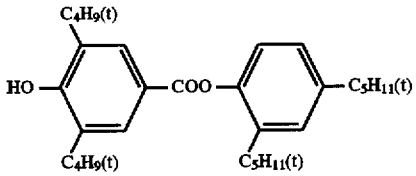
ST-2
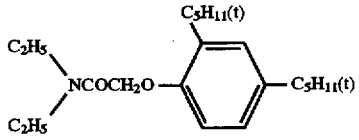
ST-3
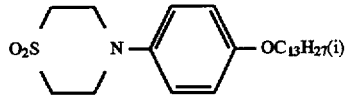
ST-4
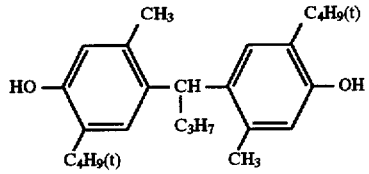
ST-5
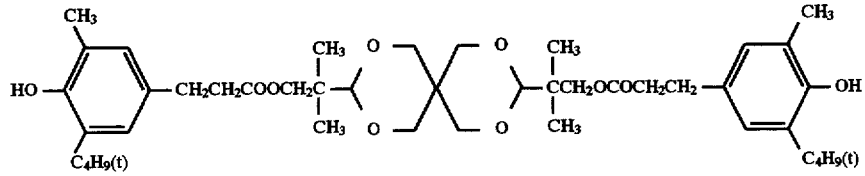
UV-1
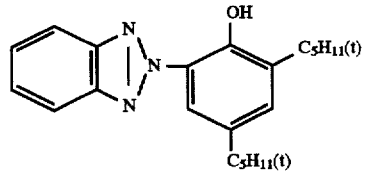
UV-2
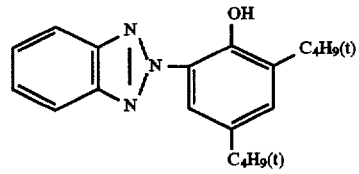

-continued

UV-3

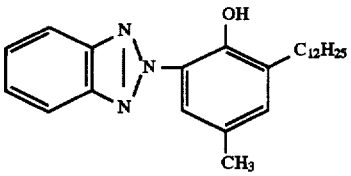

Al-1

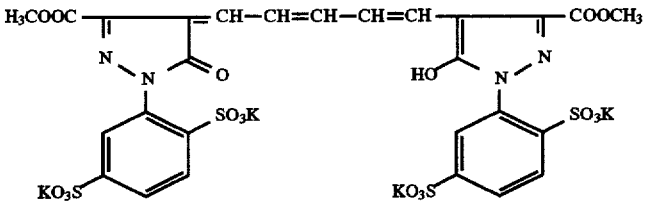

Al-2

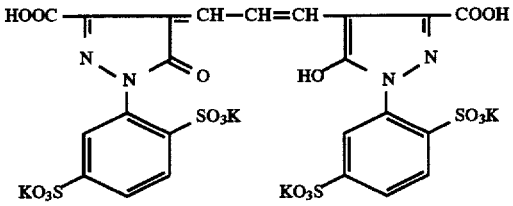

Al-1

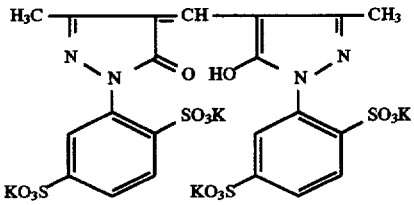

W-1

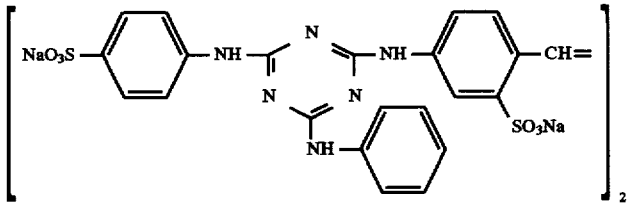

F-1

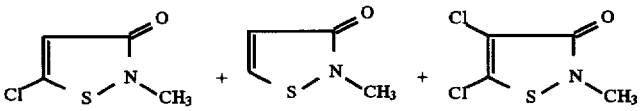

(50%) (46%) (4%) mol ratio (Preparation of blue sensitive silver halide emulsion)

To 1 liter of a 2% aqueous gelatin solution kept at 40° C., the following Solutions A and B were concurrently added spending 30 minutes while pAg was controlled to 7.3 and pH was controlled to 3.0, and then, the following Solution C and D were concurrently added spending 180 minutes while pAg as controlled to 8.0 and pH was controlled to 5.5. The pAg was adjusted according to descriptions of Japanese Patent O.P.I. Publication No. 59-45437/1984, and the pAg was controlled with an aqueous sulfuric acid or sodium hydroxide solution.

| (Solution A) | |
|---|---|
| Sodium chloride | 3.42 g |
| Potassium bromide | 0.03 g |

-continued

| | |
|---|---|
| Water was added to make a 200 ml solution. | |
| (Solution B) | |
| Sodium nitrate | 10 g |
| Water was added to make a 200 ml solution. | |
| (Solution C) | |
| Sodium chloride | 102.7 g |
| $K_2IrCl_6$ | $4 \times 10^{-8}$ mol/mol of Ag |
| $K_4Fe(CN)_6$ | $2 \times 10^{-5}$ mol/mol of Ag |
| Potassium bromide | 1.0 g |
| Water was added to make a 600 ml solution. | |
| (Solution D) | |
| Sodium nitrate | 300 g |
| Water was added to make a 600 ml solution. | |

After the addition was completed, the solution was subjected to desalting by the use of a 5% aqueous solution of Demol N produced by Kao Atlas Co., Ltd. and a 20% aqueous solution of magnesium sulfate. Then, the resulting solution was mixed with an aqueous gelatin solution to prepare a mono-dispersed cubic emulsion EMP-1 having an average grain size of 0.71 μm, a variation coefficient of grain size distribution of 0.07 and a silver chloride content of 99.5 mol %.

The mono-dispersed cubic emulsion EMP-1B was prepared in the same manner as in EMP-1, except that the addition time of Solutions A And B, and the addition time of Solutions C And D were varied. The emulsion EMP-1B had an average grain size of 0.64 μm, a variation coefficient of grain size distribution of 0.07 and a silver chloride content of 99.5 mol %.

The above-mentioned emulsions EMP-1 and EMP-1B were subjected to the most suitable sensitization employing the following compounds. Then, the sensitized EMP-1 and EMP-1B were mixed in a ratio (in terms of silver) of 1:1 to obtain a blue sensitive silver halide emulsion (Em-B).

| | |
|---|---|
| Sodium thiosulfate | 0.8 mg/mol AgX |
| Chloroauric acid | 0.5 mg/mol AgX |
| Stabilizer STAB-1 | $3 \times 10^{-4}$ mol/mol AgX |
| Stabiiizer STAB-2 | $3 \times 10^{-4}$ mol/mol AgX |
| Stabilizer STAB-3 | $3 \times 10^{-4}$ mol/mol AgX |
| Sensitizer BS-1 | $4 \times 10^{-4}$ mol/mol AgX |
| Sensitizer BS-2 | $1 \times 10^{-4}$ mol/mol AgX |

(Preparation of green sensitive silver halide emulsion)

The mono-dispersed cubic emulsion EMP-2 was prepared in the same manner as in EMP-1, except that the addition time of Solutions A And B, and the addition time of Solutions C And D were varied. The emulsion EMP-2 had an average grain size of 0.40 μm, a variation coefficient of 0.08 and a silver chloride content of 99.5 mol %. The mono-dispersed cubic emulsion EMP-2B was prepared in the same manner as in EMP-2.

Next, mono-dispersed cubic emulsion EMP-2B was prepared which had an average grain size of 0.50 μm, a variation coefficient of 0.08 and a silver chloride content of 99.5 mol %.

The above-mentioned emulsions EMP-2 and EMP-2B were subjected to the most suitable sensitization employing the following compounds. Then, the sensitized EMP-2 and EMP-2B were mixed in a ratio (in terms of silver) of 1:1 to obtain a green sensitive silver halide emulsion (Em-G).

| | |
|---|---|
| Sodium thiosulfate | 1.5 mg/mol AgX |
| Chloroauric acid | 1.0 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizer GS-1 | $4 \times 10^{-4}$ mol/mol AgX |

(Preparation of red sensitive silver halide emulsion)

The mono-dispersed cubic emulsion EMP-3 was prepared in the same manner as in EMP-1, except that the addition time of Solutions A And B, and the addition time of Solutions C And D were varied. The emulsion EMP-3 had an average grain size of 0.40 μm, a variation coefficient of 0.08 and a silver chloride content of 99.5 mol %. The mono-dispersed cubic emulsion EMP-3B was prepared which had an average grain size of 0.38 μm, a variation coefficient of 0.08 and a silver chloride content of 99.5 mol %.

The above-mentioned emulsions EMP-3 and EMP-3B were subjected to the most suitable sensitization employing the following compounds. Then, the sensitized EMP-3 and EMP-3B were mixed in a ratio (in terms of silver) of 1:1 to obtain a red sensitive silver halide emulsion (Em-R).

| | |
|---|---|
| Sodium thiosulfate | 1.8 mg/mol AgX |
| Chloroauric acid | 2.0 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizer RS-1 | $1 \times 10^{-4}$ mol/mol AgX |
| Sensitizer RS-2 | $1 \times 10^{-4}$ mol/mol AgX |
| Super sensitizer SS-2 | $2 \times 10^{-3}$ mol/mol AgX |

STAB-1: 1-(3-acetoamidophenyl)-5-mercaptotetrazole
STAB-2: 1-phenyl-5-mercaptotetrazole
STAB-3: 1-(4-ethoxyphenyl)-5-mercaptotetrazole To the red sensitive emulsion were added $2\times10^{-3}$ mol/mol AgX of SS-1.

BS-1

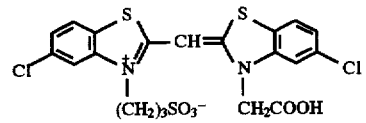

BS-2

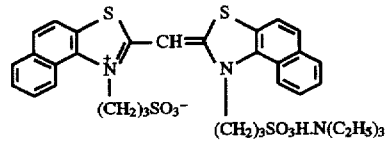

GS-1

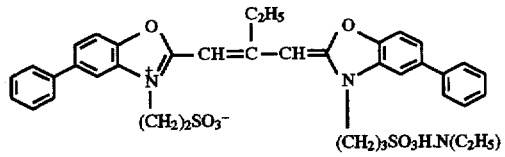

RS-1

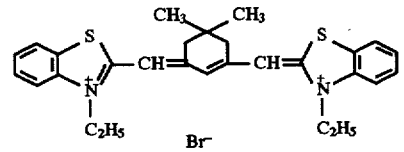

RS-2

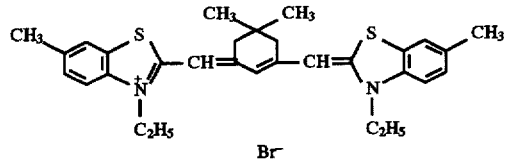

SS-1

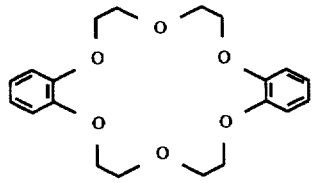

Thus, light-sensitive material sample 1-1 was prepared. Light-sensitive material samples 1-2 through 1-5 were prepared in the same manner as in sample 1-1, except that the compound of the invention, (I) or (II) was added as shown in Table 3 to the fifth layer (red sensitive layer) of Table 1.

Each of the above obtained samples was wedge exposed according to a conventional method, and running processed employing a color paper processor according to the following processes, until the bleach-fixer replenisher was replenished by a factor of two times the bleach fixer tank volume, the replenisher being replenished in a replenishing amount of 0.2 times the tank volume per day.

| Processing step | Processing temperature | Time | Amount of replenishing |
|---|---|---|---|
| Color developing | 38.0 ± 0.3° C. | 27 seconds | 80 ml |
| Bleach-fixing | 35.0 ± 0.5° C. | 27 seconds | 80 ml |
| Stabilizing | 30–34° C. | 60 seconds | 120 ml |
| Drying | 60–80° C. | 30 seconds | |

The following shows a composition of a color developing solution.

Color developer and color developer replenisher

| | Color developer | Color developer replenisher |
|---|---|---|
| Pure water | 800 ml | 800 ml |
| Triethylenediamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(β-methanesulfonamidoethyl) -3-methyl-4-aminoaniline sulfate | 6.0 g | 10.0 g |
| N,N-diethylhydroxylamine | 6.8 g | 6.0 g |
| Triethanolamine | 10.0 g | 10.0 g |
| Sodium diethylenetriamine pentaacetate | 2.0 g | 2.0 g |
| Fluorescent brightening agent (4,4'-diaminostylbenzsulfonate derivative) | 2.0 g | 2.5 g |
| Potassium carbonate | 30 g | 30 g |

Water was added to make 1 liter in total. The pH's of color developer and color developer replenisher were regulated to 10.10 and 10.60, respectively.

Bleach fixer and bleach fixer replenisher

| | |
|---|---|
| Diethylenetriamine pentaacetate ferric ammonium dihydrate | 70 g |
| Diethylenetriamine pentaacetate | 3 g |
| Ammonium thiosulfate (70% aqueous solution) | 100 ml |
| 2-Amino-5-mercapto-1,3,4-thiadiazole | 2.0 g |
| Ammonium thiosulfate (40% aqueous solution) | 27.5 ml |

Water was added to make 1 liter in total, and the bleach-fixer fixer was regulated to pH of 5.5 and the bleach-fixer replenisher to pH of 5.0 with potassium carbonate or glacial acetic acid.

Stabilizer and stabilizer replenisher

| | |
|---|---|
| Orthophenylphenol | 1.0 g |
| 5-chloro-2-methyl-4-isothiazoline-3-on | 0.02 g |
| 2-methyl-4-isothiazoline-3-on | 0.02 g |
| Diethyleneglycol | 1.0 g |
| Fluorescent brightening agent (Thinopal SFP) | 2.0 g |
| 1-hydroxyethylidene-1,1-diphosphonic acid | 1.8 g |
| Bismuth chloride (45% aqueous solution) | 0.65 g |
| Magnesium sulfate heptahydrate | 0.2 g |
| PVP | 1.0 g |
| Aqueous ammonia (25% aqueous solution of ammonium hydroxide) | 2.5 g |
| Trisodium nitrilotriacetate | 1.5 g |

Water was added to make 1 liter in total, and pH was regulated to 7.5 with sulfuric acid or aqueous ammonia.

After the running processing, each of the above obtained samples was wedge exposed, and processed according to the above processes, except that pH of the bleach-fixer after the running processing was varied as shown in Table 3.

After the running processing, the silver concentration of the bleach-fixer was 0.062 mol/liter, and the iron (II) complex content of the bleach-fixer was 12 mol % based on the total iron complex concentration.

The maximum density ($Dmax^R$) at the red sensitive layer of each of the processed samples was measured using a densitometer PDA-65 (produced by Konica Corporation).

Next, the processed samples were further processed employing the following processing solution and processing method, and the maximum density of the resulting samples was measured in the same manner as above. The difference ($\Delta Dmax^R$) between the maximum densities before and after the last processing was calculated, and was designated as a measure of leuco dye formation. The less $\Delta max^R$ is, the less the leuco dye formation.

Processing solution

| | |
|---|---|
| Ethylenediamine tetraacetate ferric ammonium salt | 70 g |

Water was added to make 1 liter in total, and the bleach-fixer was regulated to pH of 7.0 with aqueous ammonia.

Processing method

The samples were processed for 38° C. for 5 minutes.

The results are shown in Table 3 with the constitution of light sensitive material samples and pH of the bleach-fixer.

TABLE 3

| Sample No. | Compound (I) or (II) in the fifth layer (g/m²) | Bleach fixer pH | Maximum density ($Dmax^R$) | Leuco dye formation ($\Delta max^R$) |
|---|---|---|---|---|
| 1-1 | None | 6.5 | 2.43 | 0.02 |
| 1-1 | None | 6.0 | 2.41 | 0.04 |
| 1-1 | None | 5.5 | 2.35 | 0.07 |
| 1-1 | None | 5.0 | 2.26 | 0.16 |
| 1-2 | I-3(0.15) | 6.5 | 2.46 | 0.00 |
| 1-2 | I-3(0.15) | 6.0 | 2.46 | 0.01 |
| 1-2 | I-3(0.15) | 5.5 | 2.44 | 0.02 |
| 1-2 | I-3(0.15) | 5.0 | 2.41 | 0.05 |
| 1-3 | I-1(0.12) | 6.5 | 2.47 | 0.00 |
| 1-3 | I-1(0.12) | 6.0 | 2.47 | 0.00 |
| 1-3 | I-1(0.12) | 5.5 | 2.45 | 0.01 |
| 1-3 | I-1(0.12) | 5.0 | 2.43 | 0.03 |
| 1-4 | II-15(0.12) | 6.5 | 2.45 | 0.00 |
| 1-4 | II-15(0.12) | 6.0 | 2.44 | 0.01 |
| 1-4 | II-15(0.12) | 5.5 | 2.42 | 0.002 |
| 1-4 | II-15(0.12) | 5.0 | 2.40 | 0.05 |
| 1-5 | I-3(0.08),II-2(0.06) | 6.5 | 2.43 | 0.00 |
| 1-5 | I-3(0.08),II-2(0.06) | 6.0 | 2.42 | 0.01 |
| 1-5 | I-3(0.08),II-2(0.06) | 5.5 | 2.42 | 0.02 |
| 1-5 | I-3(0.08),II-2(0.06) | 5.0 | 2.39 | 0.04 |

As is apparent from Table 3, the lower the pH of the bleach-fixer, the more likely the leuco dye formation. The addition of the compound (I) or (II) to the fifth layer markedly decreases the leuco dye formation.

EXAMPLE 2

Sample 2-1 was prepared in the same manner as sample 1-1 of Example 1, except that DOP was added to the fifth layer in an amount of 0.35 g/m² instead of 0.20 g/m² and DBP was not added to the fifth layer.

Samples 2-2 through 2-8 were prepared in the same manner as sample 2-1, except that, to the fifth layer, a cyan coupler and DOP were added in an amount as shown in Table 4 and the compounds as shown in Table 4 were added in an amount as shown in Table 4.

TABLE 4

| Sample No. | Fifth layer Cyan coupler (g/m²) | Fifth layer DOP amount | Fifth layer Compound (I) or (II) (g/m²) | Fifth layer Compound (III) (IV) or (V) (g/m2) |
|---|---|---|---|---|
| 2-1 | C-1(0.25C-2(0.08) | (0.35) | — | — |
| 2-2 | C-1(0.25C-2(0.08) | (0.20) | I-1(0.15) | — |
| 2-3 | C-1(0.25C-2(0.08) | (0.20) | I-1(0.10) | IV-2(0.10) |
| 2-4 | C-1(0.25C-2(0.08) | (0.20) | II-1(0.15) | — |
| 2-5 | C-1(0.32) | (0.35) | — | — |
| 2-6 | C-1(0.32) | (0.20) | — | V-1(0.20) |
| 2-7 | C-1(0.32) | (0.20) | I-1(0.15) | — |
| 2-8 | C-1(0.32) | (0.15) | I-1(0.15) | III-1(0.10) |

The above obtained samples were wedge exposed in the same manner as in Example 1, and running processed employing a color paper processor according to the following processes, until the bleach-fixer replenisher was replenished by a factor of two times the bleach fixer tank volume.

| Processing step | Processing temperature | Time | Amount of replenishing |
|---|---|---|---|
| Color developing | 39.0 ± 0.3° C. | 22 seconds | 80 ml |
| Bleach-fixing | 39.0 ± 0.5° C. | 22 seconds | see Table 5 |
| Stabilizing | 30–34° C. | 45 seconds | 120 ml |
| Drying | 60–80° C. | 30 seconds | |

The following shows a composition of a color developing solution.

Color developer and color developer replenisher

| | Color developer | Color developer replenisher |
|---|---|---|
| Pure water | 800 ml | 800 ml |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(β-methanesulfonamidoethyl) -3-methyl-4-aminoaniline sulfate | 6.5 g | 10.5 g |
| N,N-diethylhydroxylamine | 3.5 g | 6.0 g |
| N,N-bis(2-sulfoethyl) hydroxylamine | 3.5 g | 6.0 g |
| Triethanolamine | 10.0 g | 10.0 g |
| Sodium diethylenetriamine pentaacetate | 2.0 g | 2.0 g |
| Fluorescent brightening agent (4,4'-diaminostylbenedisulfonate derivative) | 2.0 g | 2.5 g |
| Potassium carbonate | 30 g | 30 g |

Water was added to make 1 liter in total. The pH's of color developer and color developer replenisher were regulated to 10.10 and 10.60, respectively.

Bleach fixer and bleach fixer replenisher

| | Bleach fixer | bleach fixer replenisher |
|---|---|---|
| Diethylenetriamine pentaacetate ferric ammonium dihydrate | 100 g | 50 g |

-continued

Bleach fixer and bleach fixer replenisher

| | Bleach fixer | bleach fixer replenisher |
|---|---|---|
| Diethylenetriamine pentaacetate | 3 g | 3 g |
| Ammonium thiosulfate (70% aqueous solution) | 200 ml | 100 ml |
| 2-Amino-5-mercapto-1,3,4-thiadiazole | 2.0 g | 1.0 g |
| Ammonium thiosulfate (40% aqueous solution) | 50 ml | 25 ml |

Water was added to make 1 liter in total, and the bleach-fixer was regulated to pH of 5.5 and the bleach-fixer replenisher to pH of 5.0 with potassium carbonate or glacial acetic acid.

Stabilizer and stabilizer replenisher

| | |
|---|---|
| Orthophenylphenol | 1.0 g |
| 5-chloro-2-methyl-4-isothiazoline-3-on | 0.02 g |
| 2-methyl-4-isothiazoline-3-on | 0.02 g |
| Diethyleneglycol | 1.0 g |
| Fluorescent brightening agent (Thinopal SFP) | 2.0 g |
| 1-Hydroxyethylidene-1,1-diphosphonic acid | 1.8 g |
| PVP | 1.0 g |
| Aqueous ammonia (25% aqueous solution of ammonium hydroxide) | 2.5 g |
| Ethylenediaminetetraacetic acid | 1.0 g |
| Ammonium sulfite (40% aqueous solution) | 10 ml |

Water was added to make 1 liter in total, and pH was regulated to 7.5 with sulfuric acid or aqueous ammonia.

Each sample shown in Table 4 was running processed according to the processes A to D shown in Table 5, the replenishing amount of the bleach-fixer replenisher being varied as shown in Table 5 and the replenishing amount per day of the bleach-fixer replenisher being varied as shown in Table 5. The pH of the bleach-fixer was adjusted to 5.3 while processing. After the running processing, the silver concentration of the bleach-fixer and the iron (II) complex content of the bleach fixer based on the total iron complex concentration were those as shown in Table 5.

TABLE 5

| Processing No. | Replenishing amount of bleach-fixer replenisher (ml/m²) | Replenishing amount per day (× the bleach-fixer replenisher tank volume) | Silver ion concentration (mol/liter) | Ferrous complex concentration (mol %) |
|---|---|---|---|---|
| A | 120 | 0.2 | 0.032 | 7 |
| B | 80 | 0.1 | 0.068 | 11 |
| C | 50 | 0.2 | 0.090 | 18 |
| D | 50 | 0.1 | 0.093 | 16 |

The resulting samples were evaluated in the same manner as in Example 1. The results are shown in Table 6.

TABLE 6

| Sample No. | Processing No. | Maximum density ($Dmax^R$) | Leuco dye formation ($\Delta Dmax^R$) | Remarks |
|---|---|---|---|---|
| 2-1 | A | 2.38 | 0.04 | Comparative |
| 2-1 | B | 2.33 | 0.09 | Comparative |
| 2-1 | C | 2.29 | 0.14 | Comparative |

TABLE 6-continued

| Sample No. | Processing No. | Maximum density ($Dmax^R$) | Leuco dye formation ($\Delta Dmax^R$) | Remarks |
|---|---|---|---|---|
| 2-1 | D | 2.26 | 0.16 | Comparative |
| 2-2 | A | 2.41 | 0.02 | Comparative |
| 2-2 | B | 2.40 | 0.03 | Invention |
| 2-2 | C | 2.39 | 0.05 | Invention |
| 2-2 | D | 2.39 | 0.05 | Invention |
| 2-3 | A | 2.40 | 0.01 | Comparative |
| 2-3 | B | 2.39 | 0.02 | Invention |
| 2-3 | C | 2.37 | 0.04 | Invention |
| 2-3 | D | 2.36 | 0.04 | Invention |
| 2-4 | A | 2.40 | 0.02 | Comparative |
| 2-4 | B | 2.38 | 0.04 | Invention |
| 2-4 | C | 2.37 | 0.05 | Invention |
| 2-4 | D | 2.36 | 0.06 | Invention |
| 2-5 | A | 2.36 | 0.09 | Comparative |
| 2-5 | B | 2.30 | 0.16 | Comparative |
| 2-5 | C | 2.24 | 0.22 | Comparative |
| 2-5 | D | 2.21 | 0.25 | Comparative |
| 2-6 | A | 2.36 | 0.07 | Comparative |
| 2-6 | B | 2.31 | 0.12 | Comparative |
| 2-6 | C | 2.28 | 0.15 | Comparative |
| 2-6 | D | 2.26 | 0.17 | Comparative |
| 2-7 | A | 2.44 | 0.03 | Comparative |
| 2-7 | B | 2.43 | 0.04 | Invention |
| 2-7 | C | 2.41 | 0.06 | Invention |
| 2-7 | D | 2.40 | 0.06 | Invention |
| 2-8 | A | 2.43 | 0.02 | Comparative |
| 2-8 | B | 2.42 | 0.03 | Invention |
| 2-8 | C | 2.41 | 0.04 | Invention |
| 2-8 | D | 2.40 | 0.05 | Invention |

When the replenishing amount of the bleach-fixer replenisher is reduced, the concentrations of the silver ion and the ferrous salt are higher, resulting in increased leuco dye formation. However, the addition of the compound of the invention (I) or (II) to the silver halide emulsion layer shows an effect in greatly restrained leuco dye formation, and the effect is higher particularly when the replenisher amount is reduced.

The effect due to addition of compound (III), (IV) or (V) is small, but the effect due to a combination of any of these compounds with the compound (I) or (II) is larger.

Sample 2-2' was prepared in the same manner as in sample 2-2, except that compound I-1 was added to the third layer (green sensitive layer) instead of the fifth layer, and evaluated in the same manner as in sample 2-2. The leuco dye formation of sample 2-2' was found to be increased as compared with that of sample 2-2.

EXAMPLE 3

The running processing was conducted in the same manner as in Example 2, except that an automatic processor NPS-868J produced by Konica Corporation, a processing agent ECOJET-P and processing name CPK-2-J1 were used. The same evaluation as Example 1 was conducted, and it has been proved that the effects of the invention were obtained.

What is claimed is:

1. A method of forming an image comprising the steps of:

a) imagewise exposing a silver halide color photographic light sensitive material comprising a support and provided thereon, at least one photographic component layer comprising a light sensitive silver halide emulsion layer, the photographic component layer containing a compound represented by the following formula (I) or (II);

b) color developed the exposed material; and c) bleach-fixing the developed material with bleach-fixer containing a silver ion in an amount of 0.04 to 0.11 mol/liter and an iron complex in which the iron (II) complex content is 5 to 35 mol % based on the total iron complex content:

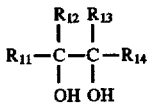

formula (I)

wherein $R_{11}$ represents an aliphatic group, an aromatic group, an acyl group, an aliphaticoxycarbonyl group, an aromaticoxycarbonyl group, an aliphaticoxy group or an aromaticoxy group; $R_{14}$ represents a hydrogen atom, an aliphatic group, an acyl group, an aliphaticoxycarbonyl group, an aromaticoxycarbonyl group, an aliphaticoxy group or an aromaticoxy group; and $R_{12}$ and $R_{13}$ independently represent a hydrogen atom, an aliphatic group or an aromatic group,

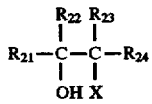

formula (II)

wherein $R_{21}$ and $R_{24}$ independently represent a hydrogen atom, an aliphatic group, an aromatic group, an acyl group, an aliphaticoxycarbonyl group, an aromaticoxycarbonyl group, an aliphaticoxy group or an aromaticoxy group; $R_{22}$ and $R_{23}$ independently represent a hydrogen atom, an aliphatic group or an aromatic group; and X represents a halogen atom, provided that $R_{21}$, $R_{22}$, $R_{23}$ and $R_{24}$ are not simultaneously hydrogen atoms.

2. The method of claim 1, wherein the photographic component layer contains said compound represented by said formula (II).

3. The method of claim 1, wherein the light sensitive silver halide emulsion layer contains said compound represented by said formula (I) or (II).

4. The method of claim 1, wherein said compound represented by said formula (I) or (II) is contained in a cyan coupler containing red sensitive layer or its adjacent layer of said photographic component layer.

5. The method of claim 1, wherein said compound represented by said formula (I) is a compound represented by the following formula (I-a):

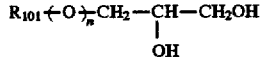

formula (I-a)

wherein $R_{101}$ represents an aliphatic group, an aromatic group or an acyl group; and n is 0 or 1.

6. The method of claim 1, wherein said compound represented by said formula (II) is a compound represented by the following formula (II-a) or (II-b):

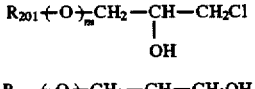

formula (II-a)

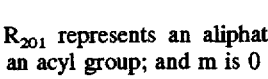

formula (II-b)

wherein $R_{201}$ represents an aliphatic group, an aromatic group or an acyl group; and m is 0 or 1.

7. The method of claim 1, wherein the silver halide emulsion layer further contains a sparingly soluble epoxy compound represented by the following formula (III), (IV) or (v):

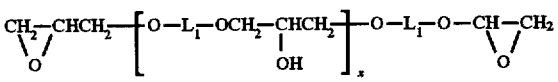

formula (III)

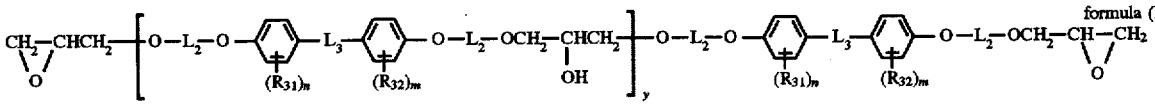

formula (IV)

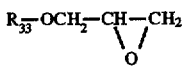

formula (V)

wherein $L_1$, $L_2$ and $L_3$ independently represent an alkylene group; $R_{31}$ and $R_{32}$ independently represent an aliphatic group or a halogen atom; $R_{33}$ represents an aliphatic group; x and y independently represent a real number of 0 to 20; and n and m independently represent an integer of 0 to 4.

8. The method of claim 1, wherein the bleach-fixer has a pH of 5.0 to 6.5.

9. The method of claim 1, wherein the bleach-fixer is replenished with a bleach-fixer replenisher in an amount of not more than 100 ml/m$^2$ of light sensitive material to be processed.

* * * * *